US005517767A

United States Patent [19]

Schechinger et al.

[11] Patent Number: 5,517,767

[45] Date of Patent: May 21, 1996

[54] GRASS AND OTHER YARD WASTE MATERIALS DRYER APPARATUS AND METHOD

[76] Inventors: Thomas M. Schechinger, 816 Ironwood Rd.; John C. Schechinger, 742 Maple Rd., both of Harlan, Iowa 51537

[21] Appl. No.: 382,242

[22] Filed: Feb. 1, 1995

[51] Int. Cl.[6] ..... F26B 17/12

[52] U.S. Cl. ..... 34/174; 34/168; 34/180

[58] Field of Search ..... 34/174, 168, 179, 34/180, 181

[56] References Cited

U.S. PATENT DOCUMENTS

| | | | |
|---|---|---|---|
| 536,277 | 3/1895 | Forrester | 34/180 |
| 3,156,541 | 11/1964 | Kalke | 34/181 |
| 3,393,904 | 7/1968 | Taylor | 34/181 |
| 3,711,959 | 1/1973 | van der Lely | 34/102 |
| 3,738,795 | 6/1973 | Heuer | 432/28 |
| 3,739,493 | 6/1973 | Nivon | 34/174 |
| 4,017,981 | 4/1977 | Ingvaldsen | 34/26 |
| 4,086,708 | 5/1978 | Westelaken | 34/174 |
| 4,412,356 | 10/1983 | Klaus et al. | 455/603 |
| 4,827,628 | 5/1989 | Bert | 34/65 |
| 5,105,563 | 4/1992 | Fingerson et al. | 34/203 |

OTHER PUBLICATIONS

"Yard Waste to Animal Feed," *Resource Recycling*, Apr. 1993, p. 35.

*Primary Examiner*—John T. Kwon
*Attorney, Agent, or Firm*—John A. Beehner

[57] ABSTRACT

A dryer apparatus and method for drying yard waste or other particulate matter is disclosed. The dryer has a generally vertical housing defining an internal drying chamber. An input device may be positioned adjacent the housing top for transferring the particulate matter into the dryer. A discharge apparatus is positioned adjacent the housing bottom for discharging dried material out of the dryer. A plurality of generally horizontal transfer devices are vertically spaced apart within the internal drying chamber, defining a plurality of drying zones associated therewith. The transfer devices are adapted to transfer the particulate matter from one drying zone to a next lower drying zone. Additionally, when filling and transferring material from one zone to another, they provide a support on which the particulate matter may. A dryer is positioned proximate to the bottom of the housing for inputting drying air into the internal drying chamber and such that the drying air enters adjacent the bottom of the housing and is transmitted upwardly through the plurality of drying zones and particulate matter contained therein thereby drying the particulate matter.

18 Claims, 7 Drawing Sheets

GRASS AND OTHER YARD WASTE MATERIALS DRYER APPARATUS AND METHOD

BACKGROUND OF THE INVENTION

1. Technical Field

This invention relates generally to a method and apparatus for efficient drying of materials. More specifically, it relates to an apparatus and method for drying yard waste so as to effect a more efficient utilization of this waste, such as for animal feed or the like. This provides an efficient and cost effective alternative disposition of such waste as contrasted with conventional methods such as landfills. The apparatus is well suited for drying numerous types of bulky materials such as citrus peels, potpourri, wood chips or hay in addition to grass clippings or other yard waste.

The average county landfill in Iowa takes in over 2,000 tons of yard waste annually. Yard waste consists mainly of leaves (approximately 30%) which are usable for bedding or sheep maintenance diets, lawn clippings (60%) which are usable for main diet, and miscellaneous (10%) such as garden vines and twigs which have questionable usage.

Generally, whereas alfalfa hay contains approximately 20% protein, lawn clippings contain approximately 27% average protein. Additionally, the lawn clippings are very palatable and digestible to sheep. Low weather stressed lawn clippings, such as spring or fall clippings, normally will have highest protein and total digestible nutrients (TDN) value and should be fed at most appropriate time, e.g., during lactation as contrasted with maintenance.

The range of yields in pounds of 72% moisture lawn clippings are approximately: 3,000 to 8,000 for dry (non-irrigated) land; 6,500 to 10,000 for irrigated land, and 10,000 to 14,000 for intensively managed (fertilized, irrigated) land. Thus, a profitable and efficient use of such material could be found if a means were available to dry this material. The present invention provides this means.

In converting lawn clippings to animal feed, molds resulting from storage must be considered. Lawn care chemical residue should not be a major concern. However, as a precaution, lawn clippings should not be fed to animals 14 days prior to slaughter. Excess urea fertilizer is toxic and should be kept in mind. Expected low levels and dilution with several lawns of material should eliminate the problem, as low levels are beneficial to digestion. Additionally, most molds originating in lawn grass or legume are not a problem since these are not toxic to ruminants.

As of 1976 there were 4 to 5 million acres worth of household lawns in the United States. Surely the amount has increased in both management and acres in the last 20 years. Each acre of land produces approximately 6,000 pounds of clippings a year. Consequently, these 5 million acres of land will produce approximately 30,000 billion lbs. of dry lawn clippings a year. This represents a potential of over 10 billion "ewe days" which would feed over 27 million ewes and accommodate total ewe hay needs for 55 thousand producers with herds of 500 head. If only 10% were salvageable, that amount would accommodate 5,500 500-head producers at a savings of 60 to 90 million dollars or approximately $24 to $36 per ewe.

The present invention has particular utility in or near urban areas where yard waste is being generated. This includes city municipalities, clubs active in recycling, zoos, animal feed and supply stores, lawn care services, golf courses, but most probably livestock producers. Other usable by-products include drying citrus peels and chopped alfalfa hay.

Yard waste constitutes 19% of the solid waste flow into United States landfills; that is approximately 35 million tons (1992 E.P.A. estimates). A federal mandate states solid waste is to be reduced an additional 25% from 1995 to the year 2000. Yard waste is a prime candidate for being banned from landfills. Present trends to reduce waste and recycle are aids in marketing our system.

2. Description of the Prior Art

Composting is the major, non landfill alternative to the present invention. However, according to many city recycling coordinators and composting operations, most are very open to other options. Of those surveyed, over 60% that had compost programs were unsatisfied with present composting programs and many of those that were satisfied were still very receptive to new or better alternatives. Composting is most often expensive and creates odor. Additionally, leaching of water from the site can cause pollution of streams and wells with nitrates, etc.

Several prior art dryers exist. However, none of these dryers has the simple vertical flow, taking advantage of the natural bridging action which occurs when lawn clippings are allowed to set.

One additional advantage of the drying apparatus of the present invention is the fact that it may be operated at low temperatures. In many cases, only ambient temperature air will be needed to accomplish the desired drying. Clearly, this makes the dryer apparatus of the present invention extremely efficient and economical since no energy need be expended in heating their air for the dryer. Additionally, low temperature systems obviously produce less heat-related damage. Most importantly, use of a lower temperature for drying of the material protects and preserves a greater quantity of the nutritionally significant elements in the material, resulting in a more valuable end product.

Therefore, it is a primary objective of the present invention is to develop a process and apparatus that would enable a sheep or other livestock producer to practically utilize lawn clippings as a feed source while significantly reducing his feed expense and thereby, making sheep and other livestock production more sustainable.

It is another objective of the present invention to provide a dryer utilizing low heat.

It is an additional objective to provide a dryer utilizing a simple vertical flow to channel the material from input to output.

It is another objective to utilize the bridging feature of the drying material to separate the drying material into a plurality of drying zones.

It is another objective to provide a dryer apparatus of a segmented construction wherein the volume of the dryer may be increased or decreased by adding or subtracting segments.

SUMMARY OF THE INVENTION

A dryer for drying yard waste or other particulate matter comprises a generally vertical housing having a top, bottom, and four walls defining an internal drying chamber; input means positioned adjacent the housing top for transferring the particulate matter into the dryer; discharge means positioned adjacent the housing bottom for discharging dried material out of the dryer; a plurality of generally horizontal transfer means vertically spaced apart within the internal drying chamber, defining a plurality of drying zones associated therewith, the transfer means adapted to transfer the particulate matter from one drying zone to a next lower drying zone; and drying means positioned proximate to the bottom of the internal drying chamber for inputting drying air into the internal drying chamber such that the drying air enters adjacent the bottom of the housing and is transmitted upwardly by convection through the plurality of drying zones and particulate matter contained therein.

A method of drying particulate matter comprises providing a dryer apparatus having a generally vertical housing having four walls defining an internal drying chamber drying means, a plurality of vertical transfer means vertically spaced apart within the drying chamber and defining a plurality of vertically stacked drying zones associated therewith, the uppermost of the drying zones being defined as the input drying zone and the lowest of which is defined as the output drying zone, output means, and inputting the particulate matter into the internal drying chamber; substantially filling the internal drying chamber, thereby bridging the particulate matter on the vertical transfer means; activating the drying means to input drying air into the bottom of the internal drying chamber and to force the drying air to flow upwardly through the internal drying chamber thereby drying the particulate matter; activating the output means to discharge dry particulate matter from the output drying zone; activating sequentially the vertical transfer means defining the drying zones above the output drying zone beginning with the one just above the output drying zone, thereby transferring the particulate matter from the drying zone above the activated transfer means to the drying zone below the activated transfer means, and continuing upward until reaching the input drying zone, while delaying activation of the transfer means defining the next higher drying zone until all or most particulate matter residing in the drying zone immediately above the activated vertical transfer means has fallen into the next lower drying zone; and inputting a new charge of particulate matter into the input drying zone.

BRIEF DESCRIPTION OF THE DRAWINGS

FIG. 1 is a perspective view of the dryer apparatus in a three-tier embodiment and also showing an output conveyor for transportation of the dried material away from the dryer and into bags for storage. The figure have also includes a top for covering the housing to prevent water and foreign matter from getting in.

DESCRIPTION OF THE PREFERRED EMBODIMENT

Figure 1:
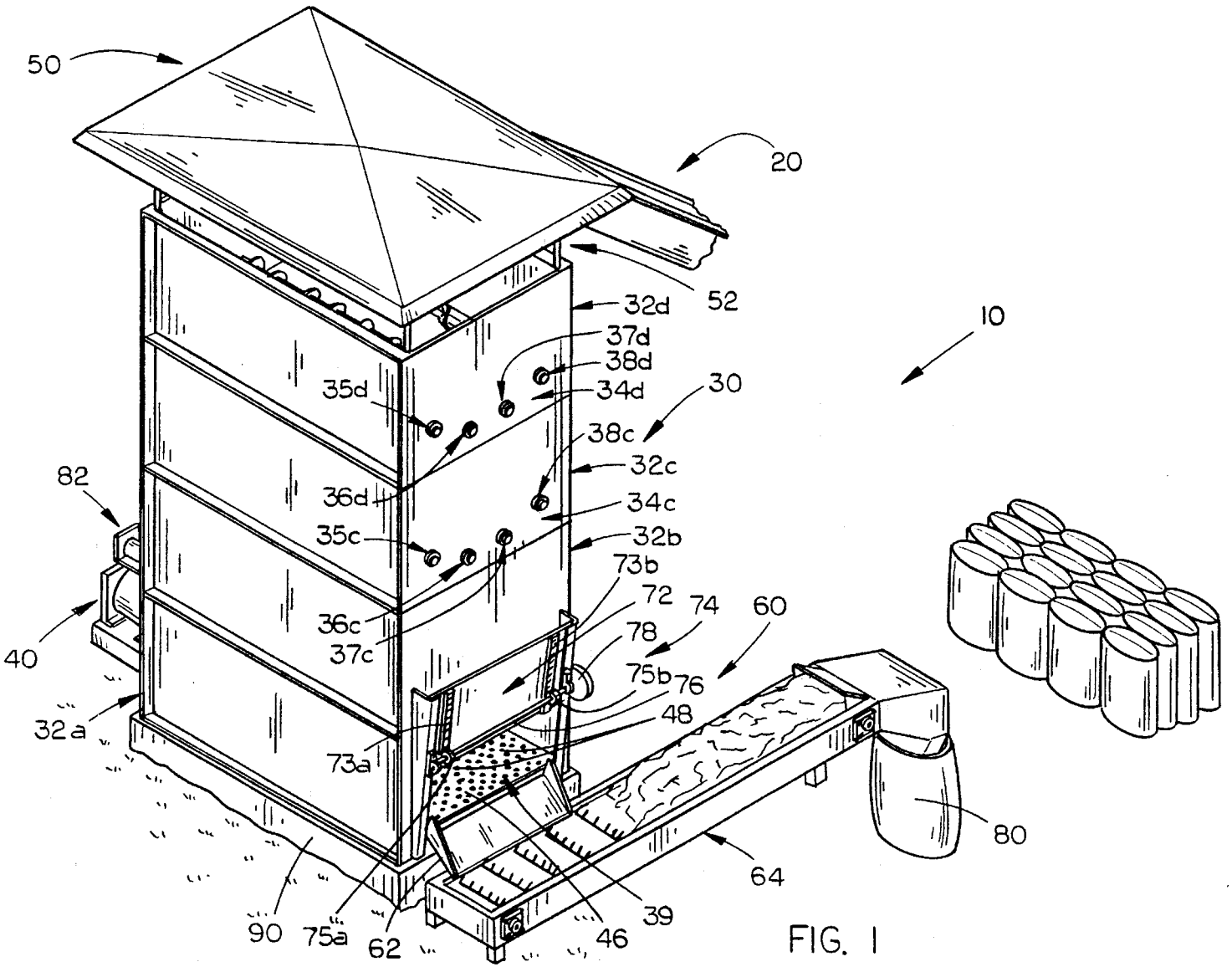

Frequently cut grass contains high nutritive value. Additionally, lawn clipping will produce a yield higher than blue grass pasture due to frequent cutting. Kentucky Bluegrass grown under proper turf grass management may far exceed, nutritionally, the conventional blue grass grown pasture.

Due to this nutritive value, it may be desirable to feed some of the spring lawn clippings directly to ewes with lambs, saving pasture for summer use and decreasing peak drying needs. Fall cuttings, which are mixed with leaves, should be fed at maintenance times (early gestation). In October and November the addition of falling leaves would reduce the lawn area needed to sustain a given number of ewes. Bales containing almost total leaves could be used for bedding at lambing time.

It is believed that the vast majority of molds commonly found on partially spoiled roughage are not toxic to ruminants. Consequently, one should not be too alarmed if some spoilage exists before drying. However, higher quality feed results if there is no spoilage in the material prior to drying. Japanese Yew branches or trimmings along with any other poisonous plants would be removed as they are toxic to animals. However, if a small amount got by, it would most likely be diluted enough as to cause no threat. Other poisonous plants present less of a problem and become a concern only when they account for 25% or more of the total intake for the day.

Clippings may average over 70% moisture upon entering the system. Clippings need to be processed during the growing season with peak periods being spring and fall. Depending on which part of the country is at issue, that growing season can be anywhere from 65 to 365 days duration.

Drying needs could be reduced by ½ if direct feeding of lawn clippings could take place during the growing season.

This equipment in the preferred embodiment will occupy approximately 1,800 cubic feet. This unit can dry up to 30 tons of wet yard waste per day, but will operate most economically when drying 10 to 30% of the maximum tonnage.

The preferred yard waste drying system consists of five steel boxes measuring approximately 7.5'×12'×5' although other sizes and configurations are possible as discussed below. The floor 39 of the bottom housing segment **32*a* is made from a type of aeration flooring which allows air to pass through from a three hp axial fan and vane axial heater mounted on the bottom in back of the unit. Centrifugal fans may also be used as they are quietest. Additionally, it should be noted that a variety of heater types may be used such as biomass burners, solar heaters, or heat exchangers or the like. The temperature may be controlled by a manual dial thermostat mounted on the side. When the contents of the bottom segment 32*a* are dry, it can be off loaded via a guillotine type door 72 located at the front. Transfer of the product out of the system is completed by activating discharge means which could be a push plate or chain and web floor. The four segments 32*b–e*** above are all basically the same and are used as holding areas for the yard waste still needing conditioning and drying. The "floors" of the remaining boxes consist of augers. Each of these "floors" is preferably powered separately with a hydraulic motor. Alternatively, an electric motor and worm gear speed reducer could be used with a chain and web floor. The sequence of the system is to off load the driest yard waste from the bottom box, then activate the auger "floor" in the segment above causing the second driest yard waste to "rain down" onto the "floor" below. This process is repeated sequentially with above segments leaving the top box empty allowing for newly arrived fully wet yard waste to be loaded into top box to begin the drying process.

FIG. 1 is a front perspective view illustrating an embodiment of the dryer apparatus 10 of the present invention. As seen in this figure, the dryer 10 is oriented in the generally vertical dimension. An input means 20 may be positioned at the top of housing 30 for input of material therein. The apparatus 10 comprises a generally vertical housing 30 at the top of which is input the material to be dried. The dryer may also comprise a roof 50. In the preferred embodiment, roof 50 would be pitched slightly and would have a size larger than housing 30 so as to permit any moisture condensing thereon to run off outside the housing. Roof 50 would also preferably be placed in a spaced relation above housing 30 to allow placement of input means, 20 therebetween. Housing 30 defines the drying chamber in which the material is dried. The vertical housing 30 is for the most part hollow. Consequently, material input by input means 20 at the top of housing 30 will initially fall therethrough until reaching floor 39 positioned at the bottom thereof. Obviously, as additional material is input to the housing 30, the material will fill upwardly. As is well understood in the art, once housing 30 has been filled with material, the material will begin to "bridge" on any horizontal surface projecting therethrough. In the present invention, this horizontal surface is provided by the plurality of augers vertically spaced throughout the housing. It could alternatively be provided by "false floors" as described below. The "bridging" effect is important for the operation of the apparatus. While the material initially will completely fill each segment, drying and settling will eventually create an air buffer between each segment. This air buffer is not detrimental to the drying operation of the invention. A wide variety of input means 20 may be used. For example, a center point auger system in conjunction with a movable conveyor belt may be employed. Another possibility is to use a blower having a movable head which could more evenly spread the input material throughout the housing. It would generally be most efficient to see that the material is spread evenly throughout the housing so that it does not form in a "pyramid" shape. As illustrated, it is envisioned that input means 20 would be positioned between the top of housing 30 and roof 50 although many alternatives, such as mounting on roof 50, are also possible.

Another important part of the invention is drying means 40. Drying means 40 is used to force air into the housing 30 and thus supplies the air for drying of the material contained therein. In the preferred embodiment, drying means 40 produces a relatively cool supply of air for drying at approximately 180° F. As seen in the figure and described in more detail below, floor 39 comprises a multitude of tiny holes 48 small enough to prevent the passage of any of the material to be dried but large enough to allow air from drying means 40 to flow therethrough. As shown in more detail in a later figure, the air from drying means 40 is injected into housing 30 below floor 39. Convection and air pressure force the air upwardly through the holes 48 in floor 39 to the top of the housing and through the material contained therein. The drying air flows upwardly throughout the vertical extent of housing 30 exiting the air gap 52 between roof 50 and the top of housing 30. Air gap 52 provides a means for the moisture-saturated air to escape the housing 30. Roof 50 may be any one of many different designs depending on the method used to fill housing 30. As mentioned above, it would be desirable to peak the roof in the center to allow any condensation to run off outside housing 30. Additionally, it may be desirable for air gap 52 to be several feet in order to accommodate placement of input means 20 between the top of housing 30 and roof 50.

It will be noted from the figure that vertical housing 30 may be further subdivided into a plurality of individual housing segments. Experimentation has indicated that the preferred number of segments is approximately five. However, the number of segments utilized may be altered depending on the amount of material desired to be dried at any one time as well as the initial and final moisture contents. Many factors are at play in choosing the number of segments. For example, smaller drying units which are easily portable, may not be practical due to supervision time and overhead cost associated with a larger number of drying cycles. Conversely, larger units may have to pull product from too great a distance. Additionally, the machines may be set up serially where the output of one dryer could be the input of another dryer.

In the embodiment illustrated in FIG. 1, there are four such individual housing segments identified as 32*a, b, c,* and *d*. It will be noted that each of the housing segments, except bottom segment 32*a*, has a set of generally horizontal transfer means positioned at the bottom thereof. In one, preferred, embodiment, the transfer means comprise a plurality of augers horizontally spaced and running lengthwise through housing 30 mounted on opposite walls. Other means may be suitable such as "false floors" created using wire "fingers" which could fold or slide out. Nonetheless, augers are believed to be the cheapest and easiest to operate. These augers are vertically disposed within the drying chamber owing to the "stacked" configuration of the housing segments. As explained in more detail below, the purpose of the transfer means is twofold. First, they provide a horizontal structure on which the material may "bridge." Thus, the transfer means divide the drying chamber into "drying zones." Secondly, the transfer means provide a mechanism for transferring material from one zone to the next lower zone.

Bottom segment 32*a* differs from the remaining upper housing segments in that the bottom of housing segment 32*a* is defined by floor 39 instead of transfer means. Segment 32*a* defines the "bottom drying zone." It will be noted from the figure that each of the segments making up vertical housing 30, except for bottom segment 32*a* comprises a series of transfer means in the lower portion thereof. For example, in the uppermost segment 32*d*, transfer means 35*d*, 36*d*, 37*d*, and 38*d* are positioned in the lower portion thereof. In the preferred embodiment, these transfer means are horizontally spaced augers mounted on opposite end walls, thereby running lengthwise through the segment.

As is more clearly illustrated in later figures, these augers comprise spiral flighting designed to urge the material contained within that segment towards the center thereof, when the augers are activated. It will also be noted in the figure, that the outermost two augers in each segment are positioned slightly above the remaining two augers. For example, in uppermost segment 32*d*, augers 35*d* and 38*d* are positioned slightly above augers 36*d* and 37*d*. The purpose for such positioning again is more efficient circulation of the material contained within that segment and more specifically to prevent such material from being consolidated against the walls of the housing 30 causing the auger to bind.

It will be noted in the figure that segment 32*c* comprises a similar series of transfer means 35*c*, 36*c*, 37*c*, and 38*c*. Segment 32*b* comprises a similar series of transfer means which are hidden from view in FIG. 1 due to the positioning of door 72. It is important to note that the configuration of the spiral flighting may be altered to accommodate different materials to be dried. For example, the diameter of the augers may be increased to inhibit any vine material from wrapping around the augers.

Although not illustrated in this figure, it is contemplated that a separator apparatus could be installed prior to inputting material into the dryer which would separate out undesirable material such as glass or the like.

As mentioned above, the lower portion of bottom segment 32*a* is defined not by a series of transfer means but rather by floor 39. It is floor 39 which provides a horizontal surface upon which the material to be dried is initially placed. Since floor 39 comprises a multitude of holes 48, air pressure and convection will cause the drying air from drying means 40 to travel upwardly through the drying chamber defined by housing 30. As the drying air travels upwardly, its moisture content increases. It is opening 46 in segment 32*a* from which the finished, dried product is taken.

Although the moisture content of the air increases as it travels upwardly through the drying chamber, drying of material occurs even in the top segment 32*d*. This is because the air would not be at 100% moisture saturation. Maximum drying efficiency would be indicated by the air reaching total saturation just as it exits the top of the dryer.

To control the release of dried material from bottom segment 32*a*, a door 72 is provided at one end thereof for releasably closing discharge opening 46. When the material is initially being loaded into the housing 30, door 72 would be in the lowered, closed position. Once drying has been completed, door 72 would be raised into the open position as illustrated and the material transferred out of segment 32*a* through opening 46. In the preferred embodiment, the raising and lowering of door 72 may be controlled by a gearing mechanism comprising a pair of tracks 73*a* and 73*b* fastened to the outside of door 72 and positioned to correspond with a pair of gears 75*a* and 75*b*, respectively, mounted on shaft 77. Shaft 77 is in turn connected to wheel 78 such that rotation of wheel 78 causes a corresponding rotation of shaft 77 and associated gears 75*a* and 75*b*. Since gears 75*a* and 75*b* are positioned to engage tracks 73*a* and 73*b*, rotation of handle 78 results in the upward or downward movement of door 72, depending on the direction of rotation. Clearly, many alternatives exist to the manual opening of door 72. For example, some type of gearing arrangement could be made to connect handle 78 to a motor which could then be activated on demand to open door 72. Similarly, some sort of automatic device could be utilized on either a timed basis or a sensor based on moisture content to open the door.

Also illustrated in FIG. 1 is one example of a discharge means 60. The purpose of discharge means 60 is twofold. First, it is utilized to remove the finished, dried material from the bottom zone of the dryer. Completion of the drying cycle will be identified by acquisition of the target moisture content. This final moisture content will vary with the use and packaging manner employed, for example, 10% moisture might be desirable if the dried material is to be packaged in "cubes". Alternatively, 15% might be desirable if the material is to be bailed and 18% for bulk storage.

Clearly, many different means may be employed to discharge the dried material from the dryer. One method illustrated in the figures is a hydraulically activated plate. Another method would be a webbed floor or conveyor assembly. These methods are illustrated and discussed in more detail below. Discharge means 60 may also comprise one or more discharge augers 66*a* and 66*b* (FIG. 2) which would be adapted to loosen or break up the dried material as it is being output from lower segment 32*a*. Devices other than augers, such as beaters may also be used. It is frequently the case that the material after it has dried will be in a somewhat solidified condition. Consequently, it may not be desirable to simply eject the entire contents of the lower segment 32*a* at one time. The discharge augers could be used to break up the material as it contacts them. However, in other cases it will be desirable to discharge the material in one large cube. In that case, the discharge augers 66*a* and 66*b* could be eliminated.

In the example illustrated in FIG. 1, the dryer may further comprise an output transfer means such as a simple conveyor apparatus, to carry the ejected dried material away from the apparatus and into some storage medium. As illustrated in the figure, conveyor 64 could be placed adjacent the open end of segment 32*a* created by open door 72. A chute 62 may be provided to channel the discharged material onto the conveyor. The conveyor 64 would then carry the material away from the dryer apparatus and could be used to direct the discharged dried material into a storage medium, such as bag 80. Clearly, many alternatives exist for discharge means 60. For example, a baler may be used in certain situations where it is desired that the discharged dry material be in baled form.

It will be noted from the figure that the dryer apparatus 10 is illustrated as sitting on a pedestal or base 90. While this is the most stable and preferred method for mounting the apparatus, other methods are available. For example, the bottom segment 32*a* could rest on a wheeled cart to enhance the mobility of the apparatus. Still further, the lower segment 32*a* could be placed on some sort of a trailer which could be towed from one location to another.

Figure 2:
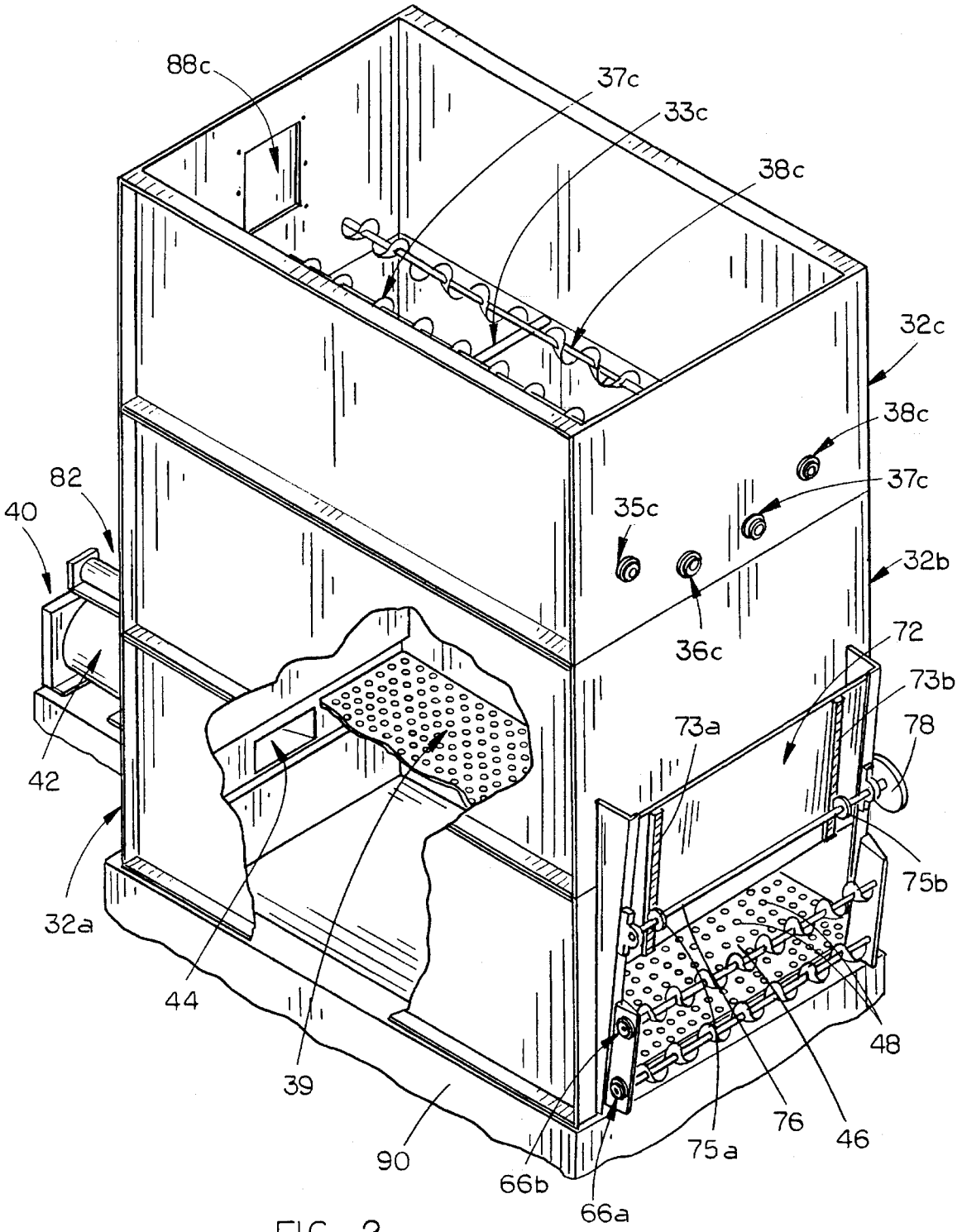
FIG. 2 is a partial sectional perspective view showing some internal components of the dryer including the vent floor and output augers.

FIG. 2 is a partial sectional perspective view of the apparatus showing some internal details thereof. For example, the figure illustrates the relative positioning of the floor 39 and air inlet 44 from drying means 40. As explained above, drying means 40 generates the drying air used to dry the particulate material contained within the vertical housing 30. As seen in this figure, the drying air from drying means 40 is introduced into the vertical housing 30 by means of air inlet 44. As shown in the figure, air inlet 44 is positioned beneath floor 39. Since the hot air from drying means 40 will rise and since floor 39 comprises a multitude of holes 48, the drying air may be transmitted into the drying compartment by convective action as well as air pressure. As mentioned above, upon the initial filling of the housing 30, the particulate matter would fall onto floor 39 and fill upwardly to the top of housing 30. Thus, the drying air introduced into housing 30 by inlet 44 will permeate throughout the vertical extent of housing 30. The air flow within housing 30 is represented graphically in FIG. 3 below.

Also shown in this figure are two of the internal augers 37*c* and 38*c* comprising a portion of the transfer means 34*c* associated with segment 32*c*. Also illustrated is the support beam 33*c* used to support augers 35*c*–38*c*. This feature is discussed below in more detail. Another feature of the invention illustrated in FIG. 2 are the discharge augers 66*a* and 66*b* associated with discharge means 60.

As seen in this figure, two discharge augers 66*a* and 66*b* are mounted at the opening 46 presented when door 72 is in the raised position. In this embodiment, the discharge augers 66*a* and 66*b* are mounted vertically with respect to one another and transversely across opening 46. In other configurations, it might be desirable to alter the orientation or spacing between the augers. Additionally, in other situations, only one auger might be necessary. Also as mentioned, a "beater" may be used to agitate and breakup the material as it exits the housing. Whatever the desired configuration, the purpose of the discharge augers remains to break up the material as it is ejected from the bottom housing segment 32*a*. As mentioned above, it is frequently the case that the particulate matter, once drying has been completed, will tend to solidify somewhat into one large mass within the bottom housing segment 32*a*. Thus, if no measures were taken to break up this material prior to discharging it, it might come out as one large block. In some situations, it might be desirable to have the discharged material in such a unitary block. In these situations, no discharge augers would be needed and they could be removed from the machine. In most situations, however, it is most desirable that the material be loose so that it may be packaged in bags or the like. Thus, the dryer apparatus is adapted to accommodate a great variety of operational constraints.

Figure 3:
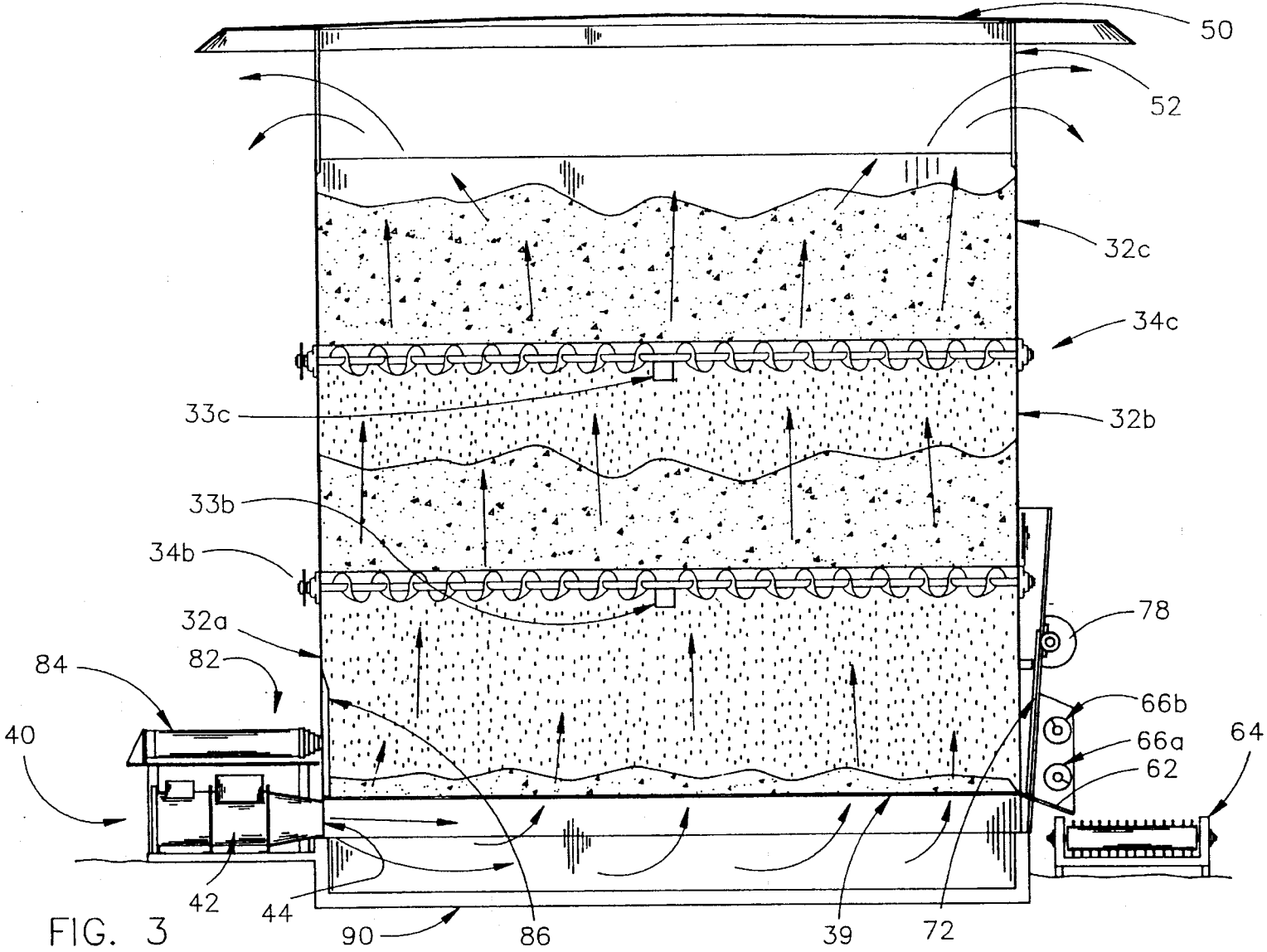
FIG. 3 is a sectional side view showing material at all three levels and indicating the air flow patterns with arrows.

FIG. 3 is a side sectional view of the dryer apparatus adapted especially to illustrate the flow of the drying air within the vertical housing 30. As indicated in the figure, the drying air originates with the drying means 40 positioned external to the housing 30. Many commercial units exist which would function suitably for use as drying means 40. One preferred manufacturer is the Sukup Company which manufactures several models. Generally, drying means 40 comprises an axial or centrifugal fan assembly 42 which is adapted to inject the drying air into the vertical housing 30 through air inlet 44 positioned at the extreme base of lower housing segment 32*a*. Due to constant operation, a "squirrel cage" type fan might be best for drying. It might be more costly (original cost) than a conventional fan, but would be quieter, require less maintenance, and require less horse power and thus be more efficient. As also mentioned above, air inlet 44 is positioned directly beneath ventilated floor 39 which permits the hot air forced into the housing to ascend through holes 48 in the floor 39 and upwardly through the entire vertical extent of the housing. As mentioned above in connection with FIG. 1, a roof 50 of some type could be adapted to be placed at the top of housing 30. However, as mentioned above, the roof 50 would probably not be placed immediately adjacent the top surface of housing 30. Rather, the roof 50 would be mounted some distance above housing 30, creating an air gap 52 therebetween. The purpose for air gap 52 would be to provide a means for the exiting of the drying air once it has traveled upwardly throughout the vertical extent of housing 30 as well as accommodate placement of the input means 20 therebetween (FIG. 1).

Figure 4:
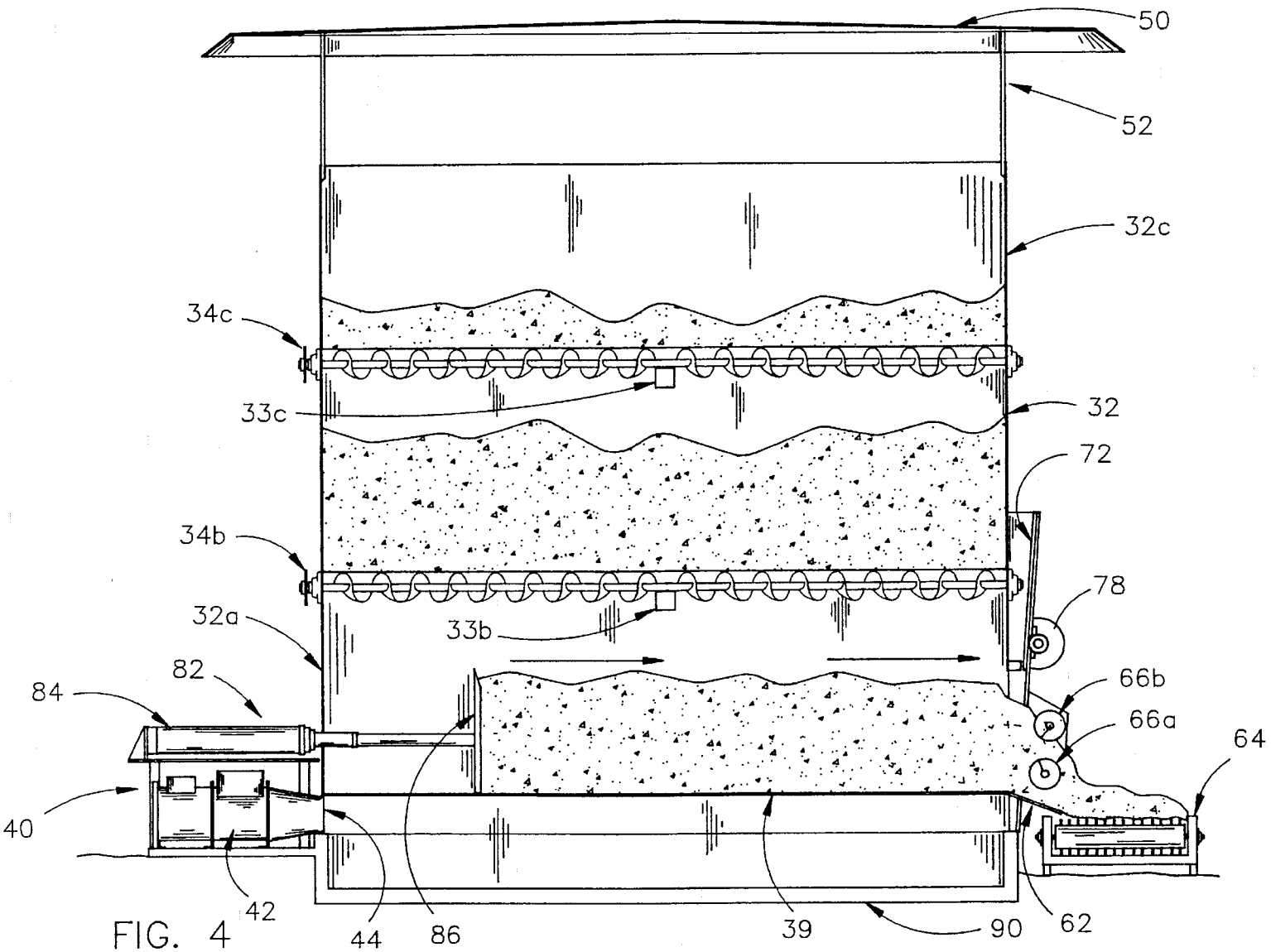
FIG. 4 is another sectional side view indicating one method of ejecting dried material from the dryer using a hydraulic push rod and plate.

Also better illustrated in FIG. 3 is the discharge portion 82 of discharge means 60. As shown in the figure, discharge portion 82 comprises a hydraulic assembly 84 and associated push plate 86. In the drying configuration, the hydraulic assembly 84 is not activated and push plate 86 is positioned adjacent the inner wall surface opposite door 72 as illustrated in the figure. In the discharge mode, as illustrated in FIG. 4, the hydraulic assembly 84 is activated, pushing plate 86 horizontally across the top surface of floor 39, pushing the dried material out opening 46 provided by raising door 72. Once the discharge of the material is complete, the hydraulic assembly 84 would be activated and return the push plate 86 to its original stored position as indicated in FIG. 3. A discharge auger or augers 66*a* and 66*b* may also be provided at the discharge opening 46 as indicated in the figure. As discussed above, the purpose of such discharge augers 66*a* and 66*b* is to agitate or break up the dried material as it exits the housing. As mentioned, the material in the housing may become somewhat solidified, as it is stationary during the later part of the drying process. Thus, if the material is simply pushed out, it may come out as a single block. Thus, discharge augers 66*a* and 66*b* provide a means to break up this material. Additionally, an output transfer means may be provided to transport the discharged material away from the dryer. One such means could be a conveyor 64. Alternatively, a packaging apparatus may be placed adjacent the discharge opening 46 to package the material as it is discharged from the dryer. Still further, it may in some cases be desirable to bale the dried material as it is discharged from the housing. In that situation, the discharge augers 66*a* and 66*b* could be removed and some type of baler apparatus installed at the discharge opening 46.

Another important feature of the invention illustrated in FIG. 3 is the manner in which the particulate matter within the housing chamber tends to "bridge" along the transfer means within the housing 30. Specifically, two of the augers associated with the upper and middle housing segments are illustrated. It will be noted observing these augers, that the orientation of the spiral flighting is altered at the end portions of the augers. Specifically, the orientation of the spiral flighting at the end portions of the augers is orientated so as to urge the material inwardly, away from the end walls, when the augers are activated.

Also shown in the figure are the support beams 33*b* and 33*c* associated with transfer means 34*b* and 34*c*, respectively. Support beams 33*b* and 33*c* run perpendicular to transfer means 34*b* and 34*c*. It can be seen from the figures that the support beams 33*b* and 33*c* are positioned in the middle of transfer means 34*b* and 34*c*. In the preferred embodiment wherein the transfer means comprises a series of augers, the support beams are positioned in a portion of the auger without spiral flighting. Thus, the main support axis of the augers is able to ride along the top surface of the support beams. In the case of the preferred embodiment where the outer augers are positioned slightly higher than the remaining augers, a support block may be used to accommodate this additional vertical distance (See FIGS. 5 and 6). Therefore, the support beams are able to support the augers and provide additional rigidity thereto. Alternatively, if the auger shafts are sufficiently sturdy or if they are sufficiently short, the support beams might not be necessary.

It will also be noted in FIG. 3 that the vertical housing 30 is comprised of three individual housing segments 32*a*, 32*b*, and 32*c*. This is in contrast to the embodiment illustrated in FIG. 1. As mentioned above in connection with FIG. 1, the number of housing segments may be varied to accommodate the volume of material to be dried according to a particular operational environment. According to the embodiment illustrated in FIG. 3, the volume of material to be dried would be somewhat less than that provided for in FIG. 1. Therefore, the number of housing segments may be reduced.

Regardless of the number of housing segments used to form housing 30, the operation of the invention remains the same. Namely, the material for drying is input into the housing at the top thereof. "Bridging" action will begin almost immediately at each set of augers in each housing segment containing material. Bridging action will continue until the augers are activated as discussed below. Drying means 40 may be activated any time after the housing has been filled to the desired level. Drying means 40 operates by injecting heated air into the base 90 of the apparatus and allowing the air to filter upwardly throughout the housing, permeating the material contained therein, as illustrated by the arrows. Since the driest air will be found in the lowest portions of housing 30, the material contained within the bottom segment 32*a* will necessarily be the driest material. Thus, it is from this segment that the dried material is taken. The discharge of dried, finished material is best illustrated in FIG. 4.

Once the drying cycle has completed, the discharge means 60 would be activated. As mentioned above, completion of the drying cycle is identified by acquisition of the targeted moisture content by the material in bottom segment 32*a*. As mentioned, this target content varies by disposition of the material. For example, if the material is to be "cubed" in a single cube, the desired moisture content might be 10%. Conversely, if the material is to be baled, the desired final moisture content might be 15%. Finally, if the material is to be used in bulk, the target moisture content might be 18%. Activation of discharge means 60 is begun by opening door 72 as described above. Discharge augers 66*a* and 66*b*, if installed, would then be activated to provide the means to break up and loosen the dried material as it is discharged from segment 32*a*. Finally, the hydraulic assembly 84 would be activated causing plate 86 to push lengthwise across segment 32*a*. Additionally, plate 86 is adapted to be positioned along the top surface of floor 39 and to be extendable across the width of the housing. Thus, when hydraulic assembly 84 is activated to push plate 86 across the surface of floor 39, the dried material residing thereon will be discharged through the opening 46 provided by raising door 72. As indicated above, a discharge conveyor 64 may be provided adjacent opening 46. Conveyor 64 would then be able to transport the discharged dry material away from the apparatus and to a bagging or other packaging device. Alternatively, the packaging apparatus may be positioned immediately adjacent the discharge opening 46.

FIG. 4 clearly illustrates the device "midway" through in the discharge mode. As indicated above, the hydraulic assembly 84 is activated pushing plate 86 towards the opening 46 provided by door 72 in the opened position. This pushing motion is clearly illustrated in FIG. 4. Additionally clearly shown in the figure, is the activation of the discharge augers 66*a* and 66*b* which, as mentioned above, are used to loosen and break up the dried material as it is ejected from the opening 46.

During the time when the material is being discharged, the transfer means in the upper housing segments 34*b* and 34*c* would not be activated. As mentioned above, the material residing on these upper transfer means is relatively stationary due to the bridging of the material which takes place when the material has been motionless for a period of time as during the drying phase. Thus, generally, no more than a small amount of material will fall into the lowest segment 32*a* when dried material is discharged therefrom.

Once the material has been discharged from the bottom segment 32*a*, the hydraulic assembly 84 would be activated, pulling plate 86 and resuming the positioning illustrated in FIG. 3. At that time, the bottom housing segment 32*a* would be devoid of material since it had been discharged therefrom. The next highest transfer means, 34*b* in the case illustrated in FIG. 4, would then be activated. Activation of transfer means 34*b* would terminate the bridging action associate with the material positioned above transfer means 34*b*. Thus, this material contained within segment 32*b* would fall downwardly and into housing segment 32*a*. At that time, segment 32*b* would then be nearly empty. Transfer means 34*c* would then be activated which would similarly dislodge the material which had bridged thereon. This material would then fall downwardly into segment 32*b* and bridge thereon.

Although it is conceivable that some of the material would continue to fall downwardly and into segment 32*a*, any such material does not present a problem since it would still be drying in segment 32*a*. Additionally, it is not necessary that each segment be completely emptied of material. It is anticipated that activation of the augers for approximately 10 minutes would completely empty that segment of material. Once all the material resident in top segment 32*c* has been transferred into segment 32*b*, input means 20 (not shown) may then be activated to input another charge of material into the housing. This new input material would then bridge on transfer means 34*c* in the same manner as that described above. A new drying cycle would then begin.

Thus, it can be seen that the dryer apparatus operates on the first-in, first-out principle, where the first material input to the apparatus is the first material which is discharged therefrom. As this first material is discharged, the transfer means associated with the housing segments are sequentially activated, upwardly through the housing segments transferring the material contained within one housing segment to the next lowest housing segment until the top segment has been emptied. The input means may then be activated and the top housing segment charged. Sequential activation of the augers may occur manually, or may be triggered using a sensor which could detect when a segment has been nearly emptied.

It will be understood by those in the art that the moisture content of the drying air will be greater as the upward position in the housing is increased. Thus, the driest material is present in the bottom segment 32*a*. Consequently, this is the segment from which the dried material is taken. Nevertheless, even in the highest segment, drying of the material is still accomplished. Air gap 52 between the top of housing 30 and roof 52 provides a means of escape for the saturated air.

Figure 5:
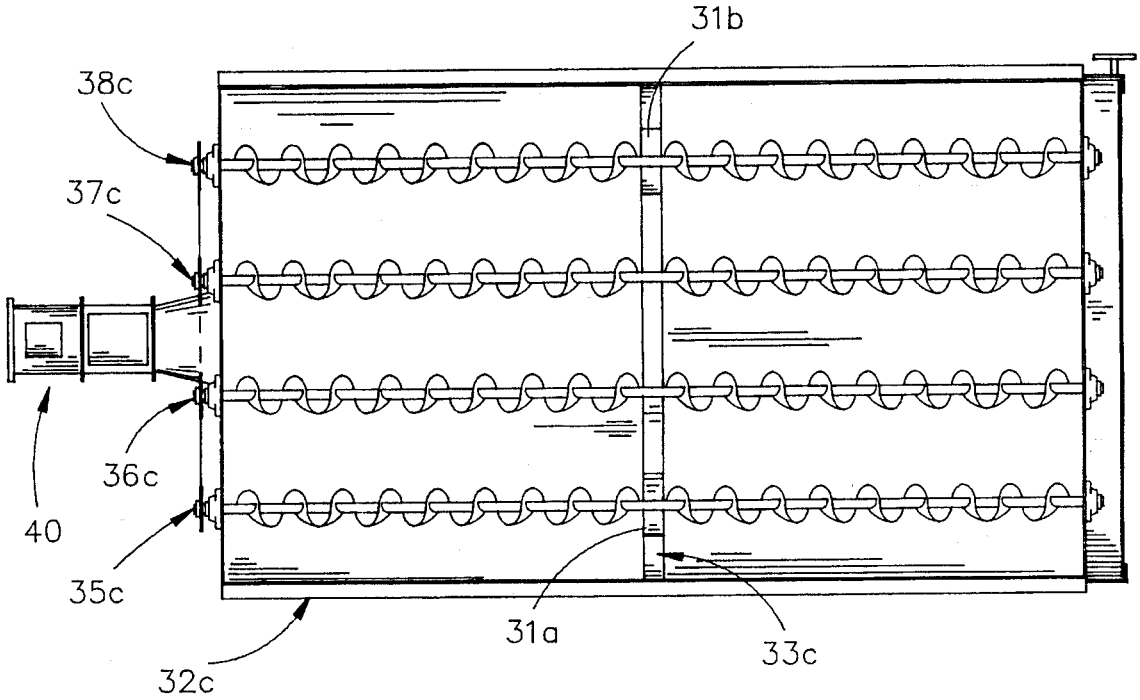
FIGS. 5 and 6 are top views showing four and five auger configurations respectively for the dryer apparatus.
Figure 6:
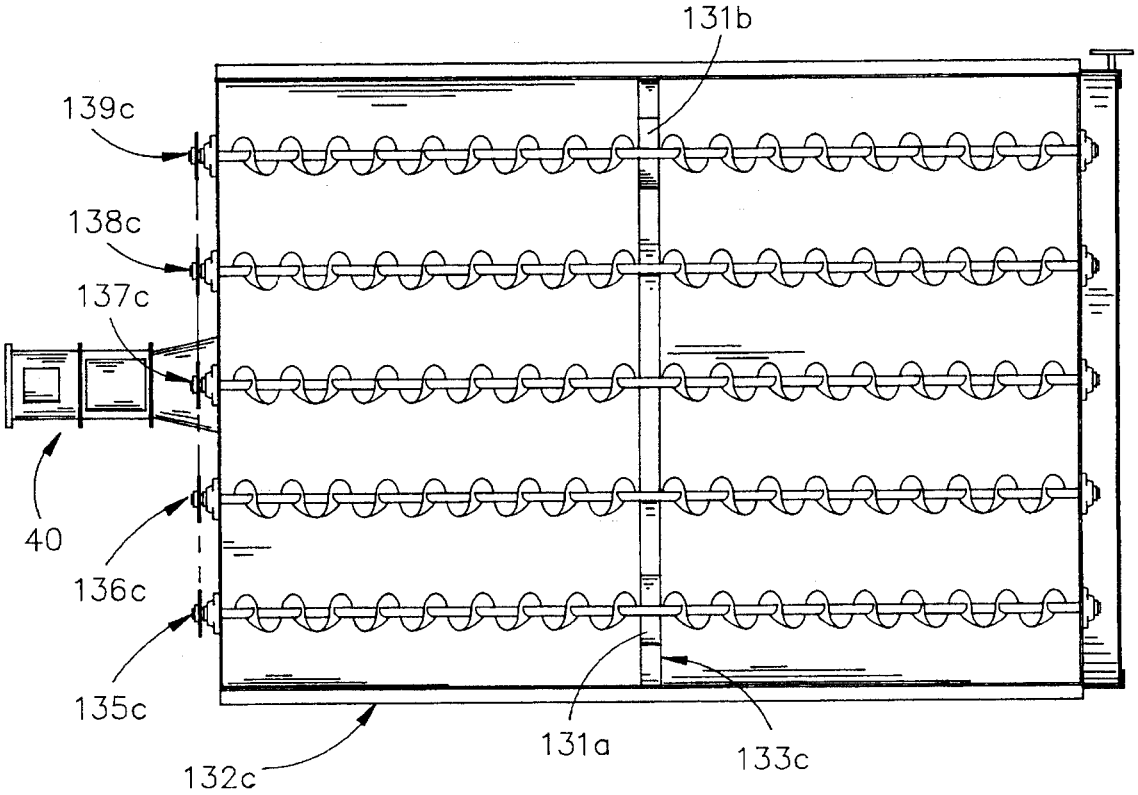

FIGS. 5 and 6 are top views of four and five auger configurations, respectively. As mentioned above, the size of the vertical housing in addition to the number of housing segments may be altered to accommodate different operational configurations. For example, the four auger configuration illustrated in FIG. 5 would correspond to the embodiments illustrated in FIGS. 1 and 2. It will be noted in those figures that each housing segment comprises four augers at the base thereof. As mentioned, the number of augers is dependent on the employment application. For example the finer the material being dried, the larger the number of augers needed to effect the bridging action. Alternatively, if a higher volume of material must be process at a given time, a wider housing and, five auger configuration of FIG. 6 may be used. Using the example of the top segment 32*d* of FIG. 1, it will be noted that a support bar 33*d* runs perpendicular to the augers 35*d*–38*d* across the width of housing 30. Since the outermost augers 35*d* and 38*d* are positioned slightly higher than the remaining augers 36*d* and 37*d* in housing segment 32*d*, blocks 31*a* and 31*b* are provided on support beam 33*d* to accommodate the higher position augers 35*d* and 38*d*.

Figure 7:
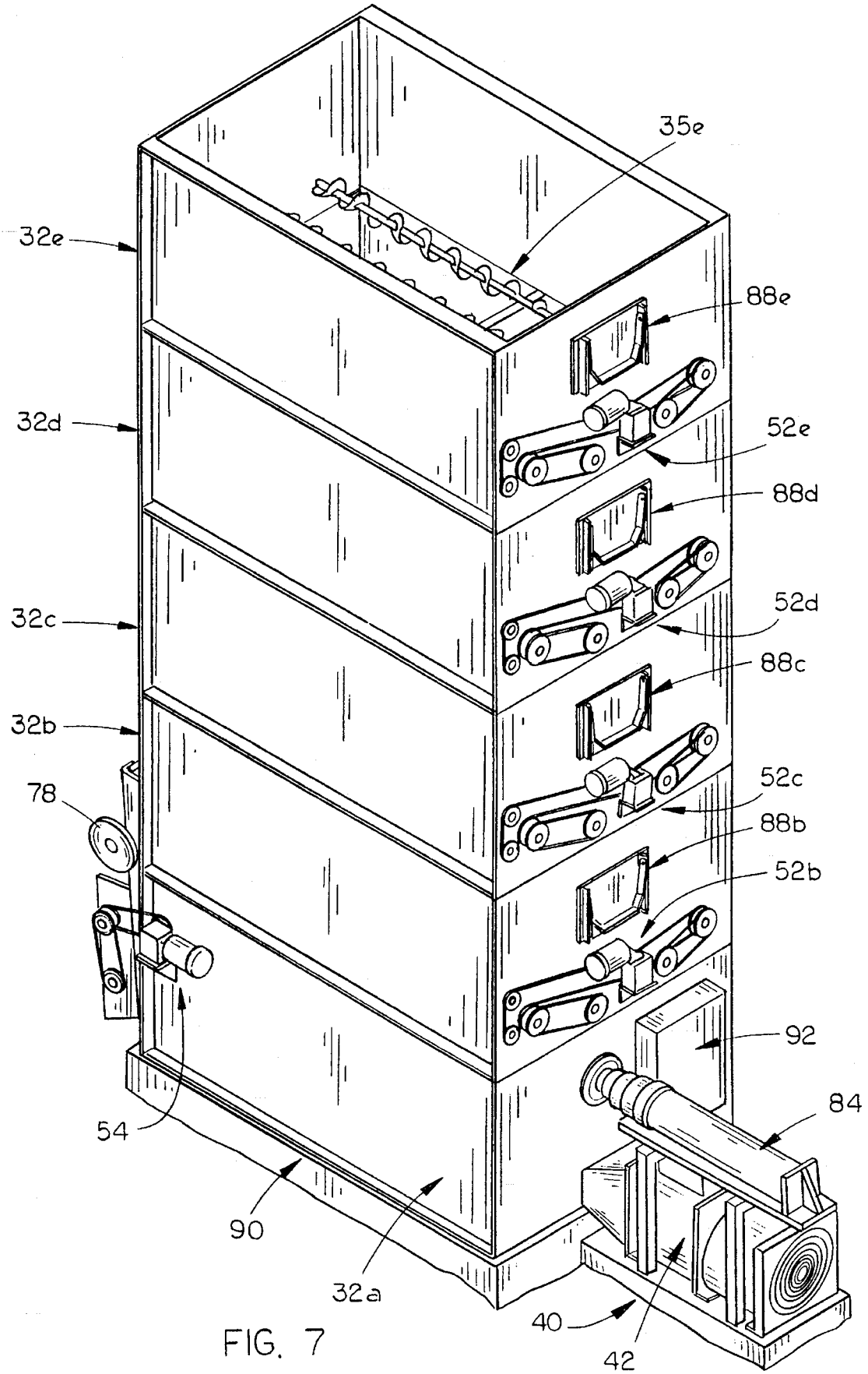
FIG. 7 is a rear perspective view showing an alternative embodiment comprising a five drawing layer apparatus and also showing the dryer motor and hydraulic cylinder for the pressure plate.

FIG. 7 is a rear perspective view of the apparatus and yet another, five segment, embodiment of the present invention. Five housing segments have been utilized to increase the vertical extent of the housing thereby providing additional time to allow additional agitation of the material to occur while passing downwardly through the housing, as well as to accommodate a greater quantity of material for drying. FIG. 7 also illustrates the driving means 52*b–e* for activating the augers associated with the transfer means for each of housing segments 32*b–e*, respectively. In the embodiment illustrated in FIG. 7, these driving mechanisms could be conventional gear and pulley operations.

Also shown in this illustration are the access means 88*b–e* which are provided at one end of each of the housing segments. The purpose of these access holes is to provide a means for the operator to enter the segment to dislodge any material which might be impeding the operation of the augers or the flow of material within the housing. Access to the segments may be by any number of equally suitable methods such as pivoting or sliding doors or the like.

Drive means 54 for the discharge augers 66*a* and 66*b* is also illustrated in FIG. 7. As with the transfer augers, the preferred method is a simple pulley operation although many suitable alternatives exist. Finally, the drying means 40 and hydraulic assembly 84 of the output discharge means 60 are illustrated. As mentioned above, the inlet 44 for the input of the drying air into the dryer is positioned at the extreme bottom portion of the bottom segment 32*a*, below floor 39.

Figure 8:
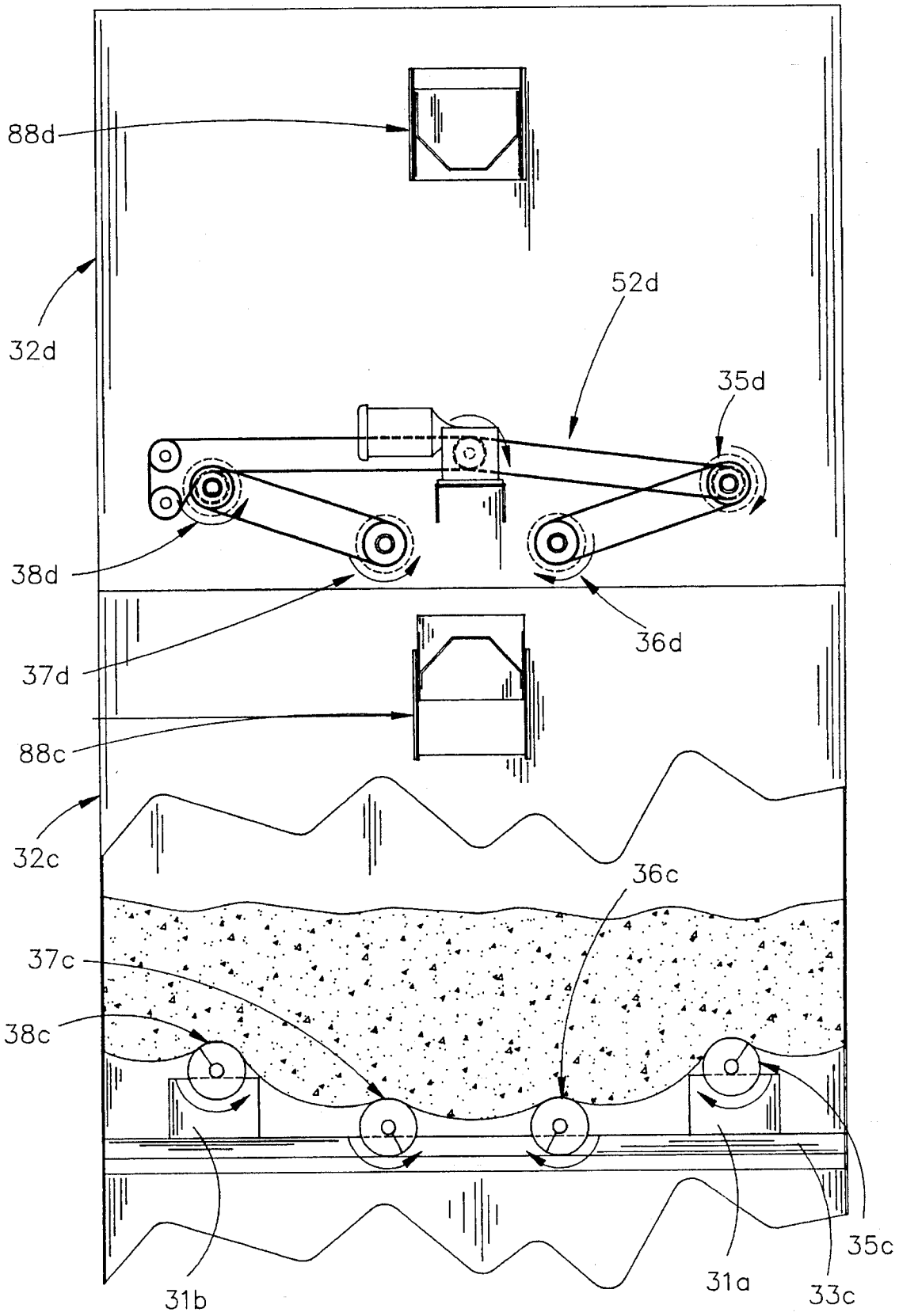
FIG. 8 is a partial sectional end view showing two drying levels with the top half being an external view showing rotation of the augers with their associated belts, the lower half being an internal view showing the level of material and how it would bridge on the augers.

FIG. 8 is an end view of two housing segments showing in particular the operation of the transfer augers in connection with housing segments 32*d* and 32*c* for example. The operation of the augers in the remaining housing segments would be identical. As seen in this figure, the two rightmost augers 35*d* and 36*d* of segment 32*d* rotate in the clockwise direction, whereas the two leftmost augers 37*d* and 38*d* rotate in the counter-clockwise direction.

Also clear in this figure is the vertical and horizontal orientation of the augers within a specific housing segment. As seen in this figure, the two outer augers, for example 35*d* and 38*d*, are positioned somewhat higher in relation to the two center augers 35*d* and 38*d*. As mentioned above, this vertical orientation, in addition to the spiral flighting orientation discussed above, greatly facilitates the movement and disbursement of the material contained within the housing segment, when the augers are activated. The direction of rotation of the augers in conjunction with the spiral flighting orientation of the spiral flighting contained thereon further acts to facilitate the even distribution of material from one housing segment to the next lower housing segment.

Also illustrated in the cutaway view of segment 32*c* is the access hole 88*c* provided for that segment. As shown in this figure, the access hole is in the partially open configuration. The access hole 88*b* may be further opened to provide additional space for entry into the housing segment. In the preferred embodiment, these access holes are sufficiently large that they may accommodate entry of the operator into the compartment. In many cases however, this will not be necessary and the access hole may be made smaller to accommodate the insertion of a probe of some type of dislodge the offending material. Finally, the external view of the upper compartment 32*d* is illustrative of the interconnection of the auger with its drive means 52*d*, namely a pulley and gear arrangement. As mentioned above, many suitable alternatives could be used to drive the augers, such as chains or direct drive motors or the like.

It is obvious that numerous other modifications and variations of the present invention are possible in view of the above teachings. For example, the number of housing segments may be varied. Additionally, the size and orientation of the spiral flighting may be altered. Still further, the design of the transfer means may utilize alternate configurations such as false floors or movable fingers. Still further the type and design of the input means and drying means may be altered as mentioned. For example, the input means could be any one of a variety of conveyors, blowers, center point augers or the like.

Therefore it is to be understood that the above description is in no way intended to limit the scope of protection of the claims and is representative only of the several possible embodiments of the present invention.

There has thus been shown and described an invention which accomplishes at least all of the stated objects.

I claim:

1. A dryer for drying yard waste or other particulate matter comprising:

a generally vertical housing having a top, bottom, and four walls defining an internal drying chamber and a discharge opening positioned adjacent said housing bottom;

a plurality of generally horizontal transfer means vertically spaced apart within said internal drying chamber, defining a plurality of drying zones associated therewith including a lowermost drying zone, said transfer means adapted to transfer said particulate matter from one drying zone to a next lower drying zone;

drying means positioned proximate to said bottom of said housing for inputting drying air into said internal drying chamber and such that said drying air enters adjacent said bottom of said housing and is transmitted upwardly through said plurality of drying zones and particulate matter contained therein thereby drying said particulate matter;

said discharge opening being positioned to open into said lowermost drying zone; and discharge means positioned adjacent said discharge opening for discharging dried particulate matter directly from the lowermost drying zone through said discharge opening and out of said dryer housing.

2. The dryer apparatus of claim 1 wherein said generally vertical housing comprises a plurality of housing segments each having a top, bottom, and four walls, said segments adapted for stacking one on top the other thereby forming said drying chamber.

3. The dryer apparatus of claim 1 wherein said discharge means comprises an opening positioned in one of said walls of said vertical housing for discharging said dried material therethrough and further comprises a door adapted for releasably closing said opening, said door being closed when particulate material is drying and opened when said material is discharged from said dryer apparatus.

4. The dryer apparatus of claim 3 wherein said discharge means further comprises a conveyor positioned adjacent said bottom of said vertical housing and operative to transport said material out of said opening.

5. The dryer apparatus of claim 1 further comprising a floor positioned adjacent said bottom of said housing thereby defining a bottom drying zone, said floor further having a plurality of holes therein permitting the passage of said drying air therethrough, said drying means being positioned to inject said drying air into said housing below said floor thereby permitting said drying air to pass therethrough and into said particulate matter residing thereon.

6. The dryer apparatus of claim 3 wherein said discharge means further comprises at least one discharge auger positioned adjacent and across said opening such that said auger contacts and agitates and thereby breaks up said dried material when it is transferred therethrough.

7. The dryer apparatus of claim 6 further comprising an output transfer means adjacent said discharge augers and operative to transport said discharged material away from said housing.

8. The dryer apparatus of claim 7 wherein said output transfer means is a conveyor.

9. The dryer apparatus of claim 1 further comprising a roof positioned adjacent said top of said vertical housing.

10. The dryer apparatus of claim 1 further comprising an input means positioned adjacent said housing top for transferring said particulate matter into said dryer.

11. The dryer apparatus of claim 10 wherein said input means is a conveyor.

12. A method of drying particulate matter comprising:

providing a dryer apparatus having a generally vertical housing having four walls defining an internal drying chamber, drying means, a plurality of vertical transfer means vertically spaced apart within said drying chamber and defining a plurality of vertically stacked drying zones associated therewith, the uppermost of said drying zones being defined as the input drying zone and the lowest of which is defined as the output drying zone, and discharge means;

substantially filling said internal drying chamber with said particular matters, thereby allowing said particulate matter to bridge on said vertical transfer means;

activating said drying means to input drying air into said bottom of said internal drying chamber and to force said drying air to flow upwardly through said internal drying chamber thereby drying said particulate matter;

activating said discharge means to discharge dry particulate matter from said output drying zone;

activating sequentially said vertical transfer means defining the drying zones above said output drying zone beginning with the one just above said output drying zone, thereby transferring said particulate matter from the drying zone above the activated transfer means to the drying zone below the activated transfer means, and continuing upward until reaching said input drying zone, while delaying activation of the transfer means defining the next higher drying zone until all particulate matter residing in the drying zone immediately above the activated vertical transfer means has fallen into the next lower drying zone; and inputting a new charge of particulate matter into said input drying zone.

13. The method of claim 12 further comprising the step of agitating said dry particular matter as it is discharged so as to break up said material.

14. The method of claim 12 further comprising the step of transferring said discharged dry material away from said dryer.

15. The method of claim 14 wherein said transferring step comprises packaging said dried material.

16. A dryer for drying yard waste or other particulate matter comprising:

a generally vertical housing having a top, bottom, and four walls defining an internal drying chamber;

discharge means positioned adjacent said housing bottom for discharging dried material out of said dryer, said discharge means comprising an opening positioned in one of said walls of said vertical housing for discharging said dried material therethrough and further comprises a door adapted for releasably closing said opening, said door being closed when particulate material is drying and opened when said material is discharged from said dryer apparatus, said discharge means further comprising a hydraulically activated push plate positioned on said housing wall opposite said opening, said plate having a size and shape approximating said opening and being operative to push dried particulate matter out said opening when said door is in said open position;

a plurality of generally horizontal transfer means vertically spaced apart within said internal drying chamber, defining a plurality of drying zones associated therewith, said transfer means adapted to transfer said particulate matter from one drying zone to a next lower drying zone; and drying means positioned proximate to said bottom of said housing for inputting drying air into said internal drying chamber and such that said drying air enters adjacent said bottom of said housing and is transmitted upwardly through said plurality of drying zones and particulate matter contained therein thereby drying said particulate matter.

17. A dryer for drying yard waste or other particulate matter comprising:

a generally vertical housing having a top, bottom, and four walls defining an internal drying chamber;

discharge means positioned adjacent said housing bottom for discharging dried material out of said dryer;

a plurality of generally horizontal transfer means vertically spaced apart within said internal drying chamber, defining a plurality of drying zones associated therewith, said transfer means adapted to transfer said particulate matter from one drying zone to a next lower drying zone and further wherein each of said plurality of vertically spaced apart transfer means comprises at least two horizontally spaced augers mounted between opposite walls of said housing, said horizontally spaced augers being spaced so as to allow said particulate matter to bridge thereon upon transfer of particulate matter to the drying zone but also permitting said particulate matter to fall therebetween upon activation of said augers; and drying means positioned proximate to said bottom of said housing for inputting drying air into said internal drying chamber and such that said drying air enters adjacent said bottom of said housing and is transmitted upwardly through said plurality of drying zones and particulate matter contained therein thereby drying said particulate matter.

18. A dryer for drying yard waste or other particulate matter comprising:

a generally vertical housing having a top, bottom, and four walls defining an internal drying chamber;

discharge means positioned adjacent said housing bottom for discharging dried material out of said dryer;

a plurality of generally horizontal transfer means vertically spaced apart within said internal drying chamber, defining a plurality of drying zones associated therewith, said transfer means adapted to transfer said particulate matter from one drying zone to a next lower drying zone and further wherein each of said plurality of vertically spaced apart transfer means comprises at least three horizontally spaced augers, the outermost of said augers, nearest the walls transverse to said walls on which said augers are mounted, being spaced vertically above the remaining of said augers and defining an upper auger pair, said upper auger pair being operative to urge said particulate matter away from said transverse walls when said augers are activated; and drying means positioned proximate to said bottom of said housing for inputting drying air into said internal drying chamber and such that said drying air enters adjacent said bottom of said housing and is transmitted upwardly through said plurality of drying zones and particulate matter contained therein thereby drying said particulate matter.

* * * * *